US006279646B1

(12) United States Patent
Ross et al.

(10) Patent No.: US 6,279,646 B1
(45) Date of Patent: Aug. 28, 2001

(54) INDUCTION HEATING OF SIDE OR DAM BLOCKS IN A CONTINUOUS CASTER

(75) Inventors: Nicholas V. Ross, Youngstown; Stanley W. Platek, New Philadelphia, both of OH (US)

(73) Assignees: Ajax Magnethermic Corporation, Warren, OH (US); Barmet Aluminum Corporation, Urishsville, OH (US)

( * ) Notice: Subject to any disclaimer, the term of this patent is extended or adjusted under 35 U.S.C. 154(b) by 646 days.

(21) Appl. No.: 08/606,068

(22) Filed: Feb. 23, 1996

(51) Int. Cl.[7] ..... B22D 11/06

(52) U.S. Cl. ..... 164/507; 164/431; 164/471; 164/481

(58) Field of Search ..... 164/471, 493, 164/507, 481, 430, 431, 432

(56) References Cited

U.S. PATENT DOCUMENTS 4,545,423 10/1985 Platek et al. .
4,586,559 5/1986 Govaerts et al. .
4,694,899 9/1987 Wood et al. .
4,934,441 * 6/1990 Wood et al. ..... 164/431
5,133,402 * 7/1992 Ross ..... 164/431

* cited by examiner

*Primary Examiner*—Kuang Y. Lin
(74) *Attorney, Agent, or Firm*—Fay, Sharpe, Fagan, Minnich & McKee, LLP

(57) ABSTRACT

An apparatus and method for continuously casting molten metal, wherein the apparatus comprises first and second endless belts and first and second edge dam block continuous belts disposed to form a casting region wherein molten metal can be cast into strip. The edge dam blocks have a length longer than the endless belts to form catenaries spaced from the first endless belt. The edge dam blocks are inductively heated with induction heaters disposed in the catenaries to avoid temperature shock to the edge dam blocks during the casting and to minimize undesirable heat losses.

3 Claims, 1 Drawing Sheet

INDUCTION HEATING OF SIDE OR DAM BLOCKS IN A CONTINUOUS CASTER

BACKGROUND OF THE INVENTION

This invention pertains to the art of continuous casting, and more particularly to the inductive heating of endless edge dam blocks associated with an endless casting machines such as the casting belt of a continuous caster.

The invention is particularly applicable to inductive heaters used to preheat the edge dam blocks of a continuous belt caster or block caster which cast molten metal and will be described with particular reference thereto. However, it will be appreciated that the invention has broader applications and may be advantageously employed in other environments and applications. Where side or dam blocks are employed that could benefit from controlled heating.

In a belt caster for continuously casting molten metal, it is known that at least two endless flexible belts constructed of a durable material, such as carbon steel, are mounted on sets of pulleys such that the front surface of the two belts are in a facing relationship. A pair of dam blocks are located at the outer edges of at least one of the endless belt front surfaces so that the dam blocks and endless belts form a casting region. Molten metal is delivered to the casting region such that the molten metal is cast into metal of varying width and gauge depending upon the dimensions of the casting region. The casting region consists of a casting zone where metal is received in a molten form, and a cooling zone where the metal is caused to solidify.

In a block casting machine typically including a caterpillar mold of articulated mold blocks, the mold cavity is also defined by opposed pairs of edge dam blocks.

The introduction of heat from the molten metal to the casting belts, mold blocks and dam blocks can cause the casting region to expand. The molten metal heating applied to the belts is often unregulated and uneven. Such unregulated application of heat causes the belts to expand in an uneven, non-regulated manner and results in distortions of the metal being cast due to distortions in the casting and cooling zone. It is a particular problem addressed by the subject invention that the dam blocks themselves may be of a temperature during the casting region to cause an undesirable heat loss from the casting region.

U.S. Pat. No. 5,133,402 discloses a system for inductively heating the first and second endless belts prior to introduction of the molten metal into the casting region to minimize heat loss from the casting due to engagement with the belts themselves. Accordingly, in this prior art system a portion of the casting region is preheated, but the problems still remain that the dam blocks will oftentimes be the cause of undesirable heat loss from the casting operation.

The present invention contemplates a new and improved apparatus and method which overcomes the above-referred to problems and others. The apparatus comprises a new continuous casting device with a heating system for preheating the dam blocks which is simple in design, conveniently sized for the physical space required to employ it, economical to manufacture, adaptable to a plurality of dimensional characteristics, durable, and which provide an improved uniform transfer of heat to dam blocks in a substantially instantaneous manner over a limited physical area such that the casting operation is more predictable and controllable to in turn provide a better uniform casting of the metal.

SUMMARY OF THE INVENTION

In accordance with the present invention there is provided an apparatus for continuously casting molten metal comprising opposed pulleys with first and second endless casting belts mounted thereon. Each of the belts have a common length and a front surface of the first belt is disposed to face a front surface of the second belt at a casting region of the apparatus. First and second edge dam blocks, each comprising a continuous chain, are disposed adjacent opposite outer edges of the front surfaces of the endless belts so that the front surfaces and the dam blocks define the casting region. The dam blocks have a common second length greater than the first lengths of the continuous chains to define first and second catenaries. The apparatus further comprises a tundish and pool feeding nozzle to provide molten metal to the casting region. First and second induction heaters inductively heat the first and second edge dam blocks at the catenaries prior to introduction of molten metal into the casting region. The dam blocks are thus inductively heated during rotation of the belts to preclude temperature distortion of the casting region and minimize undesired heat loss attributable to non-preheated dam blocks.

In accordance with another aspect of the present invention, the pulleys comprise a top nip pulley and a bottom nip pulley. The first endless belt is associated with the bottom nip pulley and the catenaries are disposed adjacent the first endless belt. The catenaries thus comprise the spacing between the first endless belt and the dam blocks of a sufficient size to accommodate the first and second induction heaters.

In accordance with a more preferred embodiment of the invention, the first and second induction heaters comprise annular coils encompassing the dam blocks at the catenaries. The first edge dam block is the load for the first induction heater and the second dam block is the load for the second induction heater.

In accordance with yet another more limited aspect of the present invention, the first and second induction heating means are connected to a common power supply and operated in common for heating the first and second edge dam blocks to a common temperature.

In accordance with a method for practicing the subject invention for continuously casting molten metal, the following steps are employed. Rotating first and second endless belts and first and second edge dam blocks disposed to form a casting region therewith. The edge dam blocks have a length longer than the endless belts to form catenaries spaced from the first endless belt. Molten metal is then provided to the casting region. The edge dam blocks are then inductively heated with induction heaters disposed in the catenaries to avoid temperature shock to the edge dam blocks during the providing step.

One benefit obtained from the present invention is a continuous casting operation, wherein the casting is closely controlled with regard to temperature to avoid temperature shock to the elements forming the region from the molten metal being cast therein.

Another benefit obtained from the present invention is the provision of instantaneous heat of a desired temperature to both sets of dam blocks in a manner independent of the heating of the belts, either inductively or from the application of the molten metal.

Yet another benefit of the present invention is the ability to employ a conventional apparatus configuration for a casting region with only minimal structural amendment to accommodate the provision of the induction heaters in the catenaries of the dam blocks.

Still further advantages of the present invention will become apparent to those of ordinary skill in the art upon reading and understanding of the detailed description of the preferred embodiments.

BRIEF DESCRIPTION OF THE DRAWINGS

The invention may take physical form in certain parts and arrangements of parts, the preferred embodiments of which will be described in detail in the specification and illustrated in the accompanying drawings, which form a part hereof, and wherein.

DETAIL DESCRIPTION OF THE PREFERRED EMBODIMENTS

Figure 1:
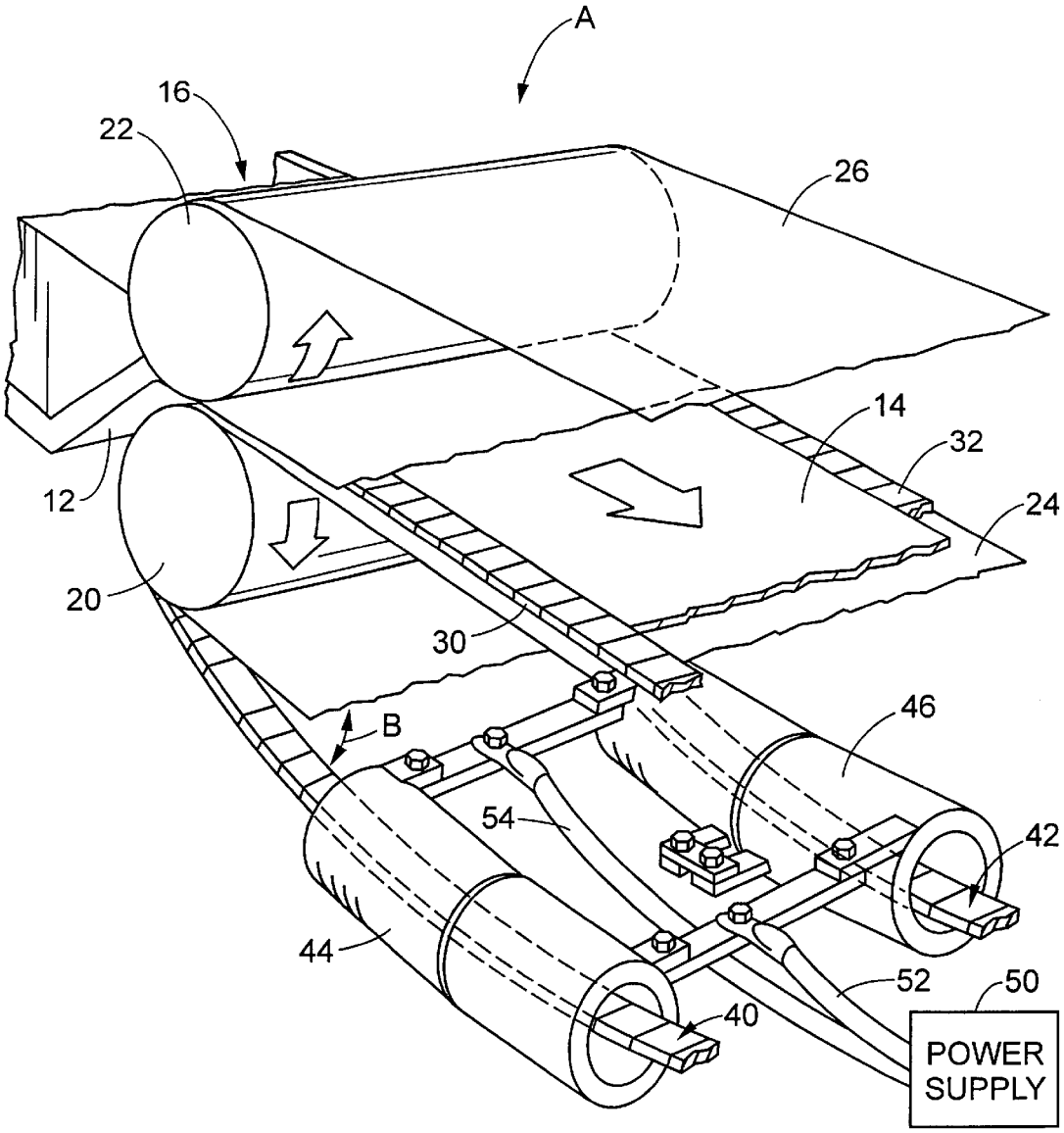
FIG. 1 is an illustration of a preferred embodiment of the subject invention.

Referring now to the drawing, wherein the showings are for purposes of illustrating the preferred embodiments of the invention only, and not for purposes of limiting same, FIG. 1 shows a continuous casting apparatus A for the casting of molten metal. The molten metal is disposed in a tundish 12 and includes a conventional closed pool heating nozzle for the formation of cast strip 14 from molten metal 16 disposed in the tundish 12. First and second nip pulleys 20, 22 are shown to support first and second endless belts 24, 26, although it can be appreciated that additional pulleys and support rollers (not shown) must be employed for the support of the belts 24, 26. The belts are mounted on the pulleys for rotation thereon and have a generally common first length. A front surface of the first endless belt is disposed to face a front surface of the second endless belt at a casting region of the apparatus A.

First and second edge dam blocks 30, 32, each comprising a continuous chain are disposed adjacent opposite outer edges of the front surfaces of the endless belts for associated rotation with the endless belts during the casting operation. The front surfaces of the endless belts and the dam blocks 30, 32 define the casting region. Although not completely seen with reference to the FIGURE, the dam blocks have common second lengths greater than the lengths of the end belts to provide a spacing B between the first endless belt 24 and the dam blocks 30, 32. The spacing B comprises first and second catenaries 40, 42 to provide sufficient spacing to accommodate induction heaters for the dam blocks alone, as will hereinafter be more fully explained.

First and second induction heaters 44, 46 are disposed for inductively heating the first and second edge dam blocks 30, 32, respectively, prior to introduction of molten metal into the casting region. Each of the induction heaters is respectively associated with one of the dam blocks so that the dam blocks are inductively heated during associated rotation with the first belt 24 to preclude temperature distortion of the casting region from the molten metal during the casting operation. Thus, the first edge dam block 30 comprises a load for the first induction heater 44 and the second edge dam block 32 comprises a load for the second induction heater 46. A high frequency power supply 50 supplies power to the coils 44, 46 through leads 52, 54. In this preferred embodiment, the coils are connected to a common power supply and operated in common for heating the first and second edge dam blocks to a common temperature; however, it is within the scope of the invention to separately heat the blocks to different temperatures to accommodate some unusual circumstances in the casting operation.

In a typical operation, the dam blocks 30, 32 are heated from 250° F. to 650° F., while each continuous belt passes through the coils. Each of the coils 44, 46 preferably comprise two sixteen (16) inch long by eight (8) inch inner diameter coils that are mounted at a small angle to accommodate the catenaries 40, 42.

Thus, the subject invention provides an improved system for inductively heating the edge dam block continuous belts with induction heaters disposed in catenaries formed by the dam block belts to avoid temperature shock to the blocks or undesired temperature loss to the casting operation during the providing step.

Although the invention has been described with reference to the preferred embodiment in a continuous belt caster, as noted above, block casters also employ side or dam blocks to define the casting region. Such a system will also benefit from the subject invention by the controlled heating of the dam blocks therein and it is within the scope of this disclosure that block casters also be included within the invention scope.

The invention has been described with reference to the preferred embodiments. Obviously, alternatively embodiments will occur to others skilled in this art upon a reading of the specification and claims.

What is claimed is:

1. An apparatus for continuously casting molten metal comprising:

pulleys;

first and second endless orbiting means for forming a casting region mounted on the pulleys for rotation thereon and having common first lengths, a front surface of the first orbiting means disposed to face a front surface of the second orbiting means at the casting region of the apparatus;

first and second edge dam blocks each comprising a continuous chain and disposed adjacent opposite outer edges in the front surfaces of the orbiting means for associated rotation with the orbiting means, wherein the orbiting means and the dam blocks define the casting region, and wherein the dam blocks have common second lengths greater than said first lengths to define first and second catenaries;

means for providing molten metal to the casting region; and, first and second induction heating means for inductively heating the first and second edge dam blocks prior to introduction of molten metal into the casting region, the induction heating means comprising annular coils encompassing the dam blocks at the catenaries, whereby the dam blocks are inductively heated during rotation of the orbiting means to preclude temperature distortion of the casting region from the molten metal.

2. The apparatus as defined in claim 1 wherein the first edge dam block is a load for the first induction heating means and the second edge dam block is a load for the second induction heating means.

3. An apparatus for continuously casting molten metal comprising:

first and second caterpillar tracks comprising articulated mold blocks disposed to form a mold cavity for casting the molten metal;

first and second edge dam blocks, each comprising a continuous chain and disposed adjacent opposite outer edges of the tracks of articulated mold blocks for corresponding movement with the blocks, wherein the mold blocks and dam blocks define the casting region, and wherein the dam blocks have a common length greater than a length of the tracks of mold blocks to define first and second catenaries;

means for providing molten metal to the casting region; and first and second induction heating means for inductively heating the first and second edge dam blocks prior to introduction of molten metal into the casting region, the induction heating means comprising annular coils encompassing the dam blocks at the catenaries, whereby the dam blocks are inductively heated during rotation of the tracks of mold blocks to preclude temperature distortion of the casting region from the molten metal.

* * * * *